US009120002B2

(12) United States Patent
Barthel

(10) Patent No.: US 9,120,002 B2
(45) Date of Patent: Sep. 1, 2015

(54) FRONT UNIT OF A SLIDING BOARD BINDING AND SLIDING BOARD BINDING

(71) Applicant: Fritz Barthel, Bad Häring (AT)

(72) Inventor: Fritz Barthel, Bad Häring (AT)

( * ) Notice: Subject to any disclaimer, the term of this patent is extended or adjusted under 35 U.S.C. 154(b) by 0 days.

(21) Appl. No.: 13/891,360

(22) Filed: May 10, 2013

(65) Prior Publication Data

US 2013/0300089 A1 Nov. 14, 2013

(30) Foreign Application Priority Data

May 11, 2012 (DE) ..... 10 2012 207 959

(51) Int. Cl.

| | |
|---|---|
| ***A63C 9/00*** | (2012.01) |
| ***A63C 9/02*** | (2012.01) |
| ***A63C 9/08*** | (2012.01) |
| ***A63C 9/084*** | (2012.01) |
| ***A63C 9/085*** | (2012.01) |
| ***A63C 9/086*** | (2012.01) |

(52) U.S. Cl.

CPC . *A63C 9/02* (2013.01); *A63C 9/006* (2013.01); *A63C 9/084* (2013.01); *A63C 9/085* (2013.01); *A63C 9/086* (2013.01); *A63C 9/0807* (2013.01); *A63C 9/08514* (2013.01); *A63C 9/08528* (2013.01); *A63C 9/08571* (2013.01)

(58) Field of Classification Search

CPC ..... A63C 9/00; A63C 11/00; A63C 13/00; A63C 1/00; A63C 5/04

USPC ..... 280/631, 627, 629, 611, 613, 617, 625, 280/615

See application file for complete search history.

(56) References Cited

U.S. PATENT DOCUMENTS

| | | | | |
|---|---|---|---|---|
| 3,909,026 | A * | 9/1975 | Salomon | 280/625 |
| 4,272,493 | A | 6/1981 | Subramanian et al. | |
| 4,348,036 | A * | 9/1982 | Settembre | 280/615 |
| 6,957,827 | B2 * | 10/2005 | Kogler | 280/613 |
| 7,320,474 | B2 * | 1/2008 | Quellais et al. | 280/615 |
| 8,439,389 | B2 * | 5/2013 | Moore et al. | 280/617 |
| 8,534,697 | B2 * | 9/2013 | Lengel | 280/617 |
| 8,544,869 | B2 * | 10/2013 | Lehner | 280/611 |
| 2010/0257754 | A1 * | 10/2010 | Trabucchi | 36/117.1 |

FOREIGN PATENT DOCUMENTS

| | | | |
|---|---|---|---|
| EP | 0199098 | A2 | 10/1986 |
| EP | 0592859 | A1 | 4/1994 |
| EP | 0620029 | A2 | 10/1994 |

* cited by examiner

*Primary Examiner* — Hau Phan

(74) *Attorney, Agent, or Firm* — Rothwell, Figg, Ernst & Manbeck, P.C.

(57) ABSTRACT

The present invention provides a front unit (100; 200) of a sliding board binding, comprising: a holding device which is set up so as to engage a sliding board boot (20) and to hold it on the sliding board binding (10) pivotably about a transverse axis extending transverse to a sliding board longitudinal axis, the front unit (100; 200) being adjustable between a closed position, in which the holding device is raised in a configuration ready for operation so as to hold a sliding board boot (20) pivotably engaged, and an open position, in which the holding device releases the sliding board boot (20), the front unit (100; 200) being adjustable into a passive position, which is different from the open position and the closed position and in which the holding device is adjusted towards the sliding board (12) into a flat configuration.

14 Claims, 4 Drawing Sheets

FRONT UNIT OF A SLIDING BOARD BINDING AND SLIDING BOARD BINDING

CROSS REFERENCE TO RELATED APPLICATION

This application is claims the benefit of German Patent Application No. 10 2012 207 959.9 filed on May 11, 2012, the disclosure of which is incorporated herein in its entirety by reference.

BACKGROUND OF THE INVENTION

1. Field of the Invention

The present invention relates to a front unit of a sliding board binding, comprising a holding means which is set up so as to engage a sliding board boot and to hold it on the sliding board binding pivotably about a transverse axis extending transverse to a sliding board longitudinal axis, the front unit being adjustable between a closed position, in which the holding means is raised in a configuration ready for operation so as to hold a sliding board boot pivotably engaged, and an open position, in which the holding means releases the sliding board boot. The invention further relates to a sliding board binding comprising a front unit and a heel unit.

2. Background of the Related Art

A front unit and a sliding board binding of this type are known for example from EP 199 098 A2 and are widely used as a touring binding in ski touring. The known binding comprises two engagement elements, the free ends of which carry mutually facing coupling pins which can pivotably engage a touring boot at two mounting openings arranged on opposite sides of a front sole portion of the boot, so as to make it possible, in a touring position of the binding, for the boot to pivot about an axis extending orthogonal to a sliding board longitudinal axis. So as to be able to use the known touring binding during descent too, the binding can be adjusted into a downhill position, in which the engagement elements are biased into the engagement position by a spring arrangement, so as to make it possible for the touring boot to be released if a force exceeding a predetermined release force acts (in particular during a fall), and in which a heel portion of the touring boot is held in place by a heel unit of the binding.

So as to make double functionality of the known touring binding possible, for ascent in the touring position on the one hand and for descent in the downhill position on the other hand, certain compromises are necessary in terms of the functionality of the known binding. Thus, on the one hand, the engagement elements and a mechanism for opening or closing the engagement elements should be configured in such a way that the touring boot can be held pivotably with maximum ease of movement in the touring position and, on the other hand, the particular loads on the binding during descent require a correspondingly high holding force from the holding arrangement. The touring binding known from EP 199 098 A2 represents a compromise of this type, and makes possible both ascent in the touring position and descent in the downhill position. In the competitive style of travel which is increasingly prominent during descents nowadays, the athlete expects the binding only to release under extreme loads. However, high release forces of this type can be implemented with a simpler and more cost-effective construction within the construction of an alpine binding. As a result, the known touring binding is particularly suitable and adapted for ascent, and the alpine binding is particularly suitable for providing high release forces for competitive downhill skiing.

BRIEF SUMMARY OF THE INVENTION

Against this background, an object of the present invention is to provide a sliding board binding which, on the one hand, is suitable for an ascent in a touring position and, on the other hand, provides high release forces with a simple and cost-effective construction in a downhill position. A further object of the invention is to provide a front unit for a sliding board binding of this type.

In accordance with a first aspect of the present invention, the object of the invention is achieved by a front unit of the type mentioned at the outset, which is adjustable into a passive position, which is different from the open position and the closed position and in which the holding means is adjusted towards the sliding board into a flat configuration.

Thus, in accordance with an important feature of the present invention, the front unit according to the invention not only has a raised configuration ready for operation, but is further adjustable into a passive position, in which it instead has a flat configuration. This provides the possibility of mounting the front unit according to the invention on a sliding board as a separate second front unit, between a first front unit and a heel unit on which a sliding board boot can be held in a downhill position. In this context, if the sliding board is held on the ski by the first front unit and the heel unit in the downhill position, the second front unit according to the invention is located below the sole of the boot without any difficulty in the passive position thereof, as a result of the flat configuration thereof, without impairing the engagement and the functionality of the downhill binding formed by the first front unit and the heel unit.

In particular, a separate front unit of this type can be retrofitted to a sliding board having an existing alpine binding, and in the case of pre-existing sliding board equipment this reduces the costs and work involved in using sliding boards for ascent in the same way as when using a touring a touring binding of the known type.

In this context, components of the type of downhill bindings known per se, in particular, can be used as the first front unit or heel unit, and are specialised for use during descent and accordingly provide high release forces. For ascent, by contrast, the second front unit according to the invention can be raised into the configuration ready for operation, in such a way that it is set up to hold the sliding board boot pivotably about a transverse axis extending transverse to the sliding board longitudinal axis. In this context, the heel unit can optionally be used as an ascent aid in the touring position.

However, the front unit according to the invention, which is adjustable between a flat and a raised configuration and of which the holding means is configured for a touring position, may in any case be mounted on a sliding board in addition to a further front unit, it being possible for the further front unit to be configured for use in a downhill position, in such a way that the sliding board binding created in this manner can have a high level of reliability and functionality for a descent, and in addition have a conventional release system for fall release during a descent.

The passive position may be adjacent to the open position, in such a way that when the front unit is adjusted from the closed position to the passive position, it initially passes through the open position, in such a way that the sliding board boot can be released from engagement with the holding means directly, and this is followed by a further adjustment movement into the passive position, with the purpose of bringing the front unit into the flat configuration. In this case, a variant of this type in particular has only two stable states (closed position and passive position).

In a constructionally simple possibility for transferring the front unit in the passive position into a flat configuration, the adjustment of the front unit into the passive position comprises a pivoting movement of the holding means. In an embodiment of this type, the movable parts are interconnected by rotary bearings, which operate with low wear even under environmental influences.

In a preferred embodiment of the present invention, it is conceivable for the holding means to comprise at least one engagement element having a coupling means for coupling to a counter-coupling means of a sliding board boot, the engagement element being mounted rotatably about a first pivot axle to adjust the front unit between the closed position and the open position, and for the holding means for adjusting the front unit into the passive position to be mounted rotatably about a second pivot axle, which is different from the first pivot axle. As a result of a configuration of this type, the front unit according to the invention gives the constructing engineer the freedom to select the axis of the at least one engagement element, for the function of the engagement element for holding the sliding board boot, in a suitable manner, for example to use engagement elements of the type known in principle per se from touring bindings and, on the other hand, to adjust the holding device on a second pivot axle, which is suitable for adjusting the holding device into a flat configuration. In particular, it is conceivable for the second pivot axle to be a pivot axle extending transverse to the sliding board longitudinal axis and in the horizontal direction, in such a way that the holding means can be folded forwards and/or backwards with respect to the sliding board longitudinal axis, so as to be laid flat close to the surface of the sliding board in the flat configuration.

Using a principle which is basically known, for example, from EP 199 098 A2, the front unit according to the invention may comprise two engagement elements, which are each formed as an angle clamp, a limb of each angle clamp, which limb carries a coupling pin for mounting the touring boot, protruding upwards in the raised configuration of the holding means, in such a way that the two coupling pins can engage left and right lateral sole portions by the corresponding coupling holes. In a preferred embodiment of the invention, for adjustment into the passive position, engagement elements of this type can be pivoted about a horizontal pivot axle extending transverse to the sliding board longitudinal axis, in such a way that the limbs of the angle clamps carrying the coupling pins are folded down (forwards or backwards) through approximately 90° and can thus be arranged flat close to the sliding board.

In a further preferred embodiment of the present invention, it is provided that the front unit comprises an arresting means, so as to prevent the front unit from being adjusted into and/or out of the passive position when arrested, and to make it possible for the front unit to be adjusted into and/or out of the passive position when non-arrested. In an embodiment of this type, the holding means may be secured in the passive position or the configuration ready for operation, so as to prevent unintentional adjustment of the holding means, and in particular so as to prevent the holding means from being adjusted into the flat configuration while the front unit is being used in a touring position.

Arresting can be provided by way of catch means or the like which are known per se. In particular when a pivotable holding means is used in accordance with the above-disclosed embodiments, it is conceivable to provide an adjustable strut member which is attached to or supported on the holding means, on the one hand, and to a component which is fixed to the sliding board, on the other hand, or to the sliding board itself, so as to block a pivoting movement back into the flat configuration. The strut may in particular be attached rotatably to one of the components, consisting of the holding means and the component fixed to the sliding board, and can be supported on the other of these two components in the configuration ready for operation of the holding arrangement, where it may in particular engage in a clearance, so as to secure the strut member when arrested. Further, it is conceivable to provide an additional securing means, which in turn secures the arresting means itself when arrested, so as to prevent accidental release of the arresting means, for example when an impact occurs during travel on uneven ground, in particular in the raised configuration ready for operation of the holding arrangement.

In a further preferred embodiment of the invention, it is provided that the holding means comprises two engagement elements, each having a coupling means for coupling to a counter-coupling means of a sliding board boot, the engagement elements being biased into the closed position by a spring means, in such a way that the coupling means engage a sliding board boot by clamping from opposite sides, the spring means preferably comprising an articulation, the engagement elements transitioning from the open position to the closed position as a result of the articulation moving, a neutral position of the spring means being passed through in the course of this transition. A holding means comprising two engagement elements of this type is based on the binding construction for touring bindings which is basically known from EP 199 098 A2, and the functionality thereof in the touring position has been demonstrated. In the aforementioned embodiment, this binding construction can advantageously also be used for a front unit according to the invention.

In a statically favourable variant, of a particularly simple construction, for pivotably mounting the aforementioned engagement elements, the two engagement elements are pivotably mounted on a shared bearing element for adjustment between the open position and the closed position, the bearing element being mounted rotatably about an adjustment axis on a base plate or on a base body, attached to the base, of the front unit. The two engagement elements can thus share a shared bearing element and thus also a shared pivot axle, in such a way that the number of components can be reduced.

A front unit according to the invention can further be configured in such a way that the holding means comprises at least one engagement element having a coupling means for coupling to a counter-coupling means of a sliding board boot, and that the front unit comprises an operating element for manually adjusting the front unit between the closed and the open position, the operating element acting on an outer portion, arranged at a distance from a sliding board central axis, of the engagement element. The arrangement of the operating element for engagement on an outer portion of the engagement element may in particular provide the possibility of arranging the operating element laterally alongside a sliding board boot, when the sliding board boot is coupled to a further front unit which is arranged in front of the front unit according to the invention, in such a way that the operating element does not collide with the sliding board boot. In this case, it is in particular unnecessary for the operating element to be of such a low constructional height in the planar configuration that it can be arranged between the sole of the sliding board boot and the surface of the sliding board.

Further, a front unit according to the present invention may comprise a locking means, which is or can be positioned in a locking position in the closed position of the holding means, so as to exert an additional locking force towards the closed position on the holding means, a locking element of the locking means acting on an outer portion, arranged at a distance from the sliding board central axis, of the engagement element. Analogously to the effects and advantages disclosed above in connection with the operating element for adjusting the front unit between the closed and open positions, the arrangement of a locking element on an outer portion of an engagement element in principle makes lateral positioning of the locking element possible, in particular alongside a sliding board boot which is held on a further front unit in a downhill position. At the same time, as a result of providing a locking unit, in the touring position the possibility can be provided of preventing the holding means from being adjusted into the open position unintentionally during use of the binding.

In accordance with a second aspect of the present invention, the object of the invention is achieved by a sliding board binding comprising a first front unit for holding a front portion of a sliding board boot in place in a downhill position, a second front unit, separate from the first front unit, for holding a front portion of a sliding board boot in a touring position, in such a way that the sliding board boot is mounted pivotably about a transverse axis extending transverse to a sliding board longitudinal axis, and a heel unit for holding a heel portion of a sliding board boot in place in a downhill position.

In the manner already described in greater detail above in relation to the first embodiment, a sliding board binding of this type has the advantage that a first front unit can be configured and optimised specifically for use in the downhill position, and in addition, a separate second front unit of the sliding board binding can be set up and optimised for the requirements during an ascent (touring position), in such a way that the two front units can be configured for the respective functions thereof, in particular without any compromise. The heel unit can be set up as part of the downhill binding system for holding the heel portion of the boot in place, and at the same time optionally, as part of the touring binding system, provide an ascent aid for supporting the boot in an oblique position with respect to the sliding board plane when the sliding board boot is held in the touring position on the second front unit.

When the sliding board boot is coupled to one front unit, out of the first front unit and the second front unit, the other front unit out of the first and second front units can be prevented from obstructing the sliding board boot in that the first front unit and/or the second front unit is a front unit in accordance with the first aspect of the invention, that is to say a front unit which can be adjusted into a flat configuration. In particular, in this case a second front unit which is arranged between the first front unit and the heel unit and which is set up for the touring position can be lowered, in such a way that it fits below the sole of a boot which is held by the first front unit and the heel unit in the downhill position. Alternatively, the first and/or the second front unit can be mounted releasably on the sliding board, in particular attached releasably to a base part which is fixed to the sliding board, in such a way that the front unit which is not actually required for the respective use can be dismounted using simple handles.

Preferably, the second front unit is or can be positioned between the first front unit and the heel unit, making it possible, when the sliding board boot is coupled to the second front unit in the touring position, to use the heel unit, which in this case is arranged below the sole of the boot, as an ascent aid. For this purpose, the heel unit may optionally be adjustable into an ascent aid position which is suitable for supporting the boot. If desired, at least a second ascent aid may be provided with a support height which is different from the first height and/or the height of the ascent aid can be made adjustable so as to make it possible to adapt the height of the ascent aid to the inclination of the terrain.

In accordance with a third aspect, the present invention relates to a front unit of a sliding board binding, comprising a holding means which is set up so as to engage a sliding board boot and to hold it on the sliding board binding pivotably about a transverse axis extending transverse to a sliding board longitudinal axis, the holding means being adjustable between a closed position so as to hold a sliding board boot pivotably engaged and an open position, in which the holding means releases the sliding board boot, comprises a tensioning means, which controls the movement of the holding means between the closed position and the open position and biases the holding means into the closed position by way of a tensile force, and a locking means, which is or can be placed in a locking position in the closed position of the holding means, so as to exert an additional locking force towards the closed position on the holding means.

A front unit of this type is known for example from EP 199 098 A2 and comprises, as a holding means, two angle clamps which carry coupling pins on the free ends thereof so as to engage a sliding board boot pivotably on laterally opposite engagement holes, the angle clamps being biased into a closed position by a tensioning means which acts between two mutually facing limbs of the angle clamps, so as to bias the coupling pins securely into the engagement with the boot. The tensioning means further serves to provide a release mechanism. If a force exceeding a predetermined release force is exerted on the coupling pins in the direction for opening the holding arrangement, for example in the event of a fall, the angle clamps are adjusted into the open position counter to the force of the tensioning position so as to release the boot.

In practice, the release mechanism may be rendered less reliable by external influences. In particular if moisture, snow or ice accumulates in the mounting holes of the ski boot, the coupling pins do not penetrate far enough into the mounting holes and the coupling engagement is weakened. At the same time, in the known tensioning means the magnitude of the tensile force of the tensioning means is dependent to a significant extent on the position of the holding means, and decreases considerably when the holding means moves away from the closed position. The deposition of snow or ice in the coupling holes of the ski boot thus additionally leads to a reduced holding force from the holding means.

In the conventional binding, the problem can be counteracted at least in the touring position in that an additional locking means is provided, and can be placed in a locking position in the closed position of the holding means so as to lock the closed position. For this purpose, a locking lever is actuated and inserts a blocking element into a pivot region of the angle clamp.

In the conventional binding, there is basically no tolerance compensation when the position of the coupling means in the engagement position differs from the normal position, as a result of the deposition of snow or ice in the coupling holes of the boot or as a result of wear or manufacturing tolerances. If the distance between the coupling means is too large as a result of snow or ice deposits, it may not be possible to bring about the locking position or this may require a large exertion of force. However, it is precisely in this case that the additional locking cannot be dispensed with, since in this part of the movement of the holding means, at some distance from the closed position, there is a greatly reduced tensile force acting towards engagement with the boot, as a result of the spring characteristic of the tensioning means. On the other hand, if there is a deposit of snow or ice, a similar set of problems arises when the known binding is used in the downhill position. In this case, a lock is dispensed with so as to ensure release during a fall, but in a very competitive style of travel, the tensile forces which are reduced as described above can lead to release of the front unit when this is not desired by the athlete. Care is accordingly required during entry. Pivoting the boot, so as to dig snow and ice out of the coupling holes using the grooves on the coupling pins, leads to secure holding, but there is still the risk of forgetting this measure.

Against this background, an object of the present invention in accordance with the third aspect is to provide a front unit for a touring binding which applies a reliable holding force for holding the touring boot in the touring position and/or in the downhill position, and provides a sufficient and definable engagement force, in particular when snow or ice is deposited between the holding arrangement and the sliding board boot.

In accordance with the third aspect of the invention, this object is achieved by a locking means, which comprises a spring element for providing the locking force. Thus, according to the invention, the locking is provided not by rigid blocking of the adjustment movement of the holding means, but instead by the defined spring force of a spring element (for example a metal spring, in particular a flat spiral spring or a leaf spring, or an elastomeric body). A spring element may act with a predetermined force towards an engagement between the holding means and the sliding board boot, it also being possible to maintain this defined force over a particular adjustment path of the holding means in a predefined manner. Thus, even if there is a deposit of snow or ice and this results in the position of the holding means necessarily being somewhat altered, it can be ensured that a defined additional locking force acts towards the engagement between the holding means and the boot.

Thus, if the front unit is used in a downhill position, a release force of a release mechanism of the front unit can be controlled by the locking force of the spring element, in such a way that in particular weakening of the tensile force of the tensioning means, when the holding means moves away from the closed position, can be compensated by the locking force of the spring element of the locking means. If for example in a preferred embodiment of the invention the holding means passes through a neutral position during the transition between the closed position and the open position, and thus the tensile force of the holding means loses a significant amount of tensile force during the movement away from the closed position and towards the neutral position, the locking means can provide a substantially constant locking force in a movement range adjacent to the neutral position, in such a way that the release force can be kept at a sufficient, constructionally well definable value.

Alternatively or in addition, in a touring position of the front unit, the locking means according to the invention may ensure that, irrespective of the precise position of the holding means, in particular if there is a deposit of snow or ice, a sufficient locking force acts on the holding means so as to prevent incorrect release during ascent. In the touring position too, if a holding means is used which passes through a neutral position between the open position and the closed position in the manner described above, in particular when approaching the neutral position, the spring element of the locking means can apply a sufficient locking force so as to prevent the front unit from opening unintentionally even during ascent.

A front unit in accordance with the third aspect of the invention may in particular be a front unit in accordance with the first aspect of the invention, and comprise at least one of the features disclosed above in connection with the first aspect, so as to achieve the corresponding advantages. In particular, a front unit in accordance with the third aspect of the invention may be set up for adjustment into a flat configuration (passive position) when the holding means comprises two engagement elements which are each held rotatably about an axis of rotation, each engagement element comprising: a first lever arm which cooperates with the tensioning means and a second lever arm which carries a coupling means for coupling to a counter-coupling means of a sliding board boot, the engagement elements being biased into the closed position by the tensioning means in such a way that the coupling means engage a sliding board boot by clamping from opposite sides, and the locking means cooperating with the second lever arm of one of the two engagement elements. In this case, the locking means may be arranged on a lateral portion of the front unit and optionally be positioned alongside a sliding board boot. Further, as a result of the aforementioned features, spatial separation can be achieved between the tensioning means, which acts on the two lever arms, and the locking means, which cooperates with one of the two engagement elements.

A simple implementation of the locking means in accordance with the third aspect of the invention is achieved in that the holding means comprises at least one engagement means, which is mounted pivotably about an axis of rotation, comprising at least one coupling means for coupling to a counter-coupling means of a sliding board boot, and in that the locking means comprises a locking element, which is mounted rotatably about an axis which is kept stationary with respect to the position of the axis of rotation of the engagement element, the spring element connecting the locking element to the engagement element. A locking means of this type can manage in particular with a relatively small number of functionally significant elements.

A further alternative possibility for implementing a locking means in accordance with the third aspect is that the locking means comprises: a connecting element, which is mounted on the engagement element rotatably about a first pivot axle, a locking element, which is connected to the connecting element rotatably about a second pivot axle, and a tensioning element, which is biased by the spring element and is connected to the locking element rotatably about a third pivot axle. Providing a connecting element, together with the locking element and the tensioning element, creates an articulation arrangement, which provides an advantageous transmission of force between the tensioning element and the holding arrangement as a function of the position of the pivot axes. For example, by selecting the pivot axes appropriately, a knee-joint-like articulation arrangement can be created, and makes it possible to transfer large forces and for example makes comfortable manual operation possible.

BRIEF DESCRIPTION OF THE DRAWINGS

In the following, the invention is described in greater detail by way of preferred embodiments with reference to the appended drawings, in which.

DETAILED DESCRIPTION OF THE INVENTION

Figure 1:
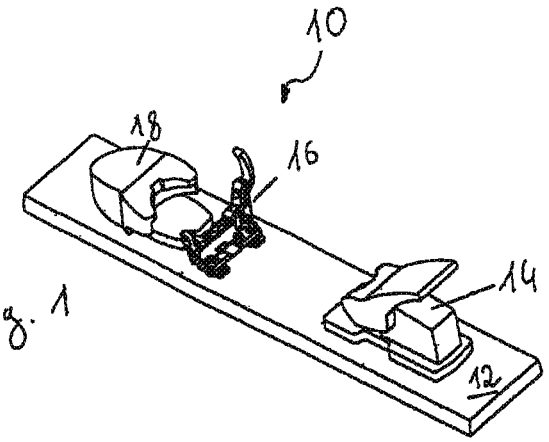
FIG. 1 is a perspective view of a sliding board binding in accordance with a first embodiment of the present invention.

FIG. 1 shows a three-part sliding board binding 10 in accordance with a first embodiment of the sliding board biding, a heel unit 14 being fastened to a sliding board 12, and a first front unit 18 and a second front unit 16 being fastened to the sliding board 12. In a preferred embodiment, the second front unit 16 is arranged between the first front unit 18 and the heel unit 14. In a particularly preferred embodiment, the second front unit 16 can be adjusted from a configuration ready for operation towards the sliding board into a flat configuration.

Figure 2:
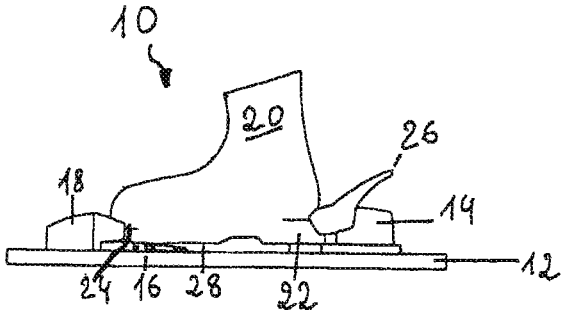
FIG. 2 is a side view of the sliding board binding shown in FIG. 1, which is holding a sliding board boot in a downhill position.

FIG. 2 shows the sliding board binding 10 in a downhill position, in which a sliding board boot 20 is held in a front portion 24 by the first front unit 18 and in a heel portion 22 by the heel unit 14. In this context, in the downhill position of the sliding board binding 10, the second front unit 16 is located in a flat configuration below the sole 28 of the sliding board boot 20. Preferably, the height of the second front unit 16 is less than 25 mm in a flat configuration, resulting in the possibility of fastening alpine bindings of the type known per se to the sliding board via spacers (not shown). This ensures that, on the one hand, the distance between the boot sole and the sliding board is large enough for the second front unit 16 to be located below the sole 28 of the sliding board boot 20 in a flat configuration and, on the other hand, by comparison with the conventional mounting position of an alpine binding, the travel properties of the sliding board are only slightly affected during descent in a downhill position, as a result of the mounting position of the alpine binding brought about by the spacers.

In an even more strongly preferred embodiment, the height of the second front unit 16 in a flat configuration is less than 12 mm, resulting in the possibility of fastening a plurality of alpine bindings of the type known per se to the sliding board in the conventional manner, the height of the front unit 16 in a flat configuration ensuring that, on the one hand, the distance between the boot sole and the sliding board is large enough for the second front unit 16 to be located below the sole 28 of the sliding board boot 20 in a flat configuration and, on the other hand, the travel properties of the sliding board during descent in a downhill position largely correspond to those of a sliding board which is merely equipped with one alpine binding.

Alternatively, the first and/or second front unit may be mounted releasably on the sliding board, in particular attached releasably to a base part which is fixed to the sliding board, in such a way that the front unit which is not actually required for the respective use can be dismounted using simple handles.

Figure 3:
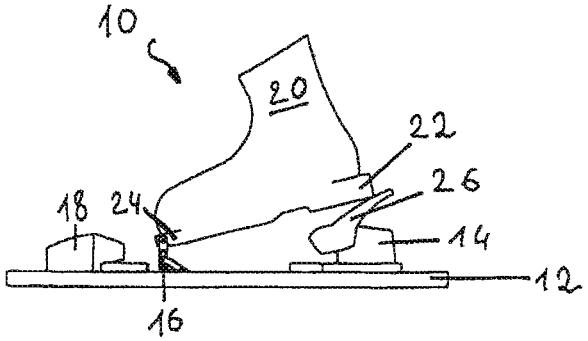
FIG. 3 is a side view of the sliding board binding shown in FIG. 1, in a touring position, holding a sliding board boot.

FIG. 3 is a side view of the sliding board binding 10, the front portion 24 of the sliding board boot 20 being held in a configuration ready for operation and in a closed position by the second front unit 16, the second front unit 16 being located in a raised configuration. In a preferred development of this embodiment, while the front portion 24 is held by the second front unit 16, the heel portion 22 can be supported by the heel unit 14. In this context, the heel unit 14 may comprise an upper portion 26 which is formed for supporting the heel portion 22 of the sliding board boot as an ascent aid.

Figure 4:
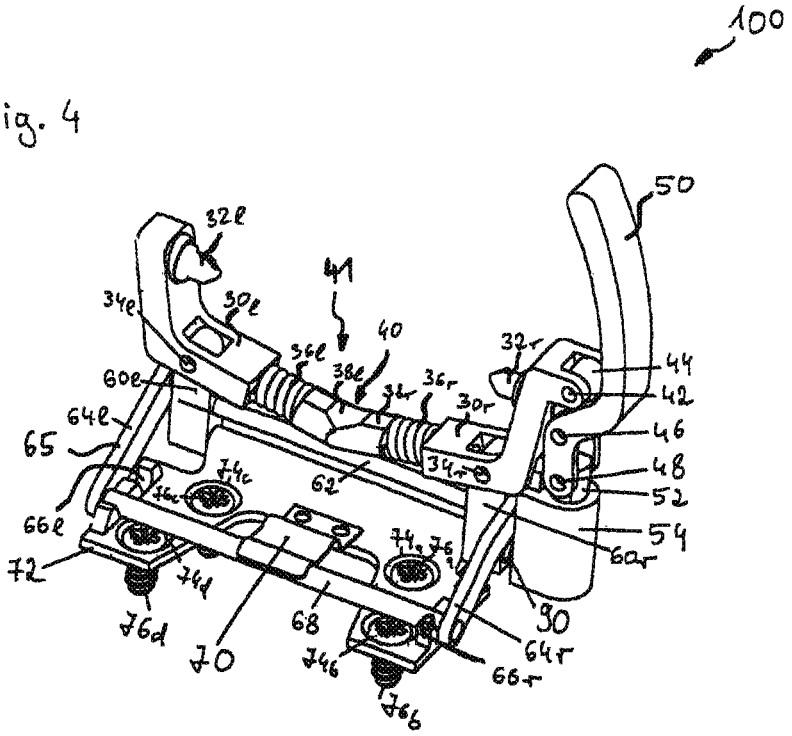
FIG. 4 is a perspective view of a front unit in accordance with a first embodiment of the present invention, in a configuration ready for operation and in a closed position.

FIG. 4 shows a front unit 100 in accordance with a first embodiment of the present invention, which can be used for example as a second front unit 16 of the sliding board binding 10 of the first embodiment. The front unit 100 comprises a base plate 72 and a holding means attached releasably or unreleasably thereto, so as to engage a sliding board boot 20, preferably by means of at least one engagement element 30*l*, 30*r*, and to hold it on the front unit pivotably about a transverse axis extending transverse to a sliding board longitudinal axis. Preferably, the base plate 72 is fixed to the sliding board by means of holes 74*a*, 74*b*, 74*c*, 74*d* and screws 76*a*, 76*b*, 76*c*, 76*d*. In an alternative variant, the front unit is fastened to a movable base body (not shown). The at least one engagement element 30*l* 30*r* may comprise at least one coupling means 32*l*, 32*r*, which engages in at least one associated mounting opening of the sliding board boot 20 and is preferably in the form of a coupling pin. Preferably, the at least one engagement element is mounted pivotably about a pivot axle 34*l*, 34*r*.

Figure 5:
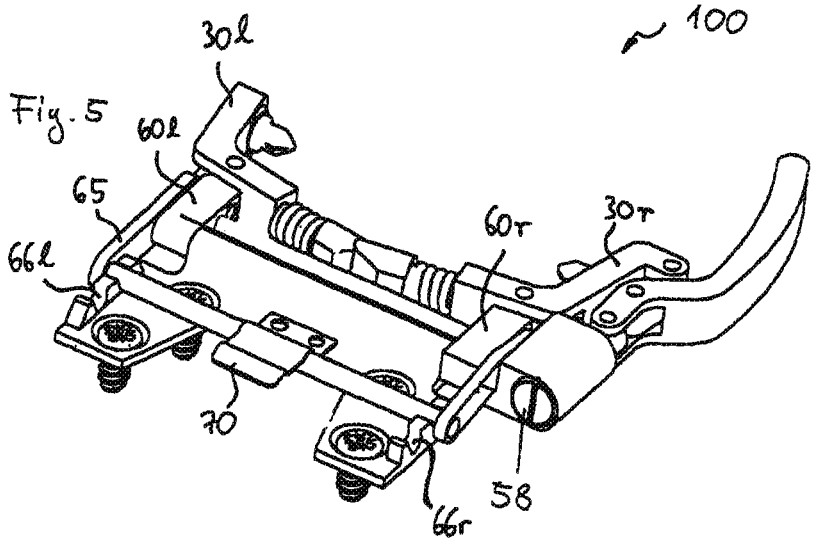
FIG. 5 is a perspective view of the front unit shown in FIG. 4 in a passive position.

The front unit 100 is adjustable from the preferably raised configuration ready for operation, shown in FIG. 4, into a passive position shown in FIG. 5, which is different from the open and closed positions. The adjustment into the passive position, which is characterised by a flat configuration with respect to the upper side of the sliding board, preferably comprises a pivoting movement of the holding means. In a preferred embodiment of the front unit, the pivoting movement is ensured by a bearing element which is rotatably mounted on a base plate 72 and to which the holding means is attached, the bearing element preferably comprising a left bearing element side part 60*l* and a right bearing element side part 60*r*, which are preferably connected by a bearing element strut member 62. Preferably, the pivot axle 90 required for carrying out the adjustment of the front unit into the passive position by way of a pivoting movement is different from the pivot axle 34*l*, 34*r* of the at least one engagement element, and in particular extends transverse to the sliding board longitudinal axis.

The front unit may comprise an arresting means, which preferably comprises a lug 65 and associated clearances 66*l*, 66*r*, the lug 65 preferably comprising two lug side elements 64*r*, 64*l* and a lug transverse element 68. The arresting means prevents the front unit from being adjusted into and out of the passive position when arrested, and makes these adjustments possible when non-arrested, the arrested state preferably being defined in that the lug 65 is engaged by the clearances 66*l*, 66*r*, and the non-arrested stated preferably being defined in that the lug 65 is not engaged by the clearances 66*l*, 66*r*.

In a preferred development of this embodiment, unintentional release of the arrested state is prevented by an internal arresting device 70, the internal arresting device preferably comprising a spring element 70.

In a further preferred embodiment, the holding means comprises two engagement elements 30*l*, 30*r* each having an associated coupling means 32*l*, 32*r*, the engagement elements 30*l*, 30*r* being biased into the closed position by a spring means 41. Preferably, the spring means 41 comprises two tension springs 36*l*, 36*r*, which are guided on guide pins (not shown) formed cohesively with the engagement elements 30*l*, 30*r*, and which support end caps 38*l*, 38*r* which are mounted slidably on the guide pins, the end caps 38*l*, 38*r* being in contact with one another and thus forming an articulation 40. Preferably, the spring means 41 passes through a neutral position of the spring means 41 in the course of the transition from the open position to the closed position of the front unit, which can be initiated by pressing down the articulation 40.

In the embodiment shown, the two engagement elements 30*l*, 30*r* are mounted pivotably on a shared bearing element, the bearing element cohesively comprising the bearing elements 60*l*, 60*r* and the bearing element strut member 62 and being pivotably mounted on the base plate 72.

Preferably, the embodiment further comprises a laterally attached lever (operating element) 50 for adjusting the front unit between the closed and the open position, the lever 50 acting, via a connecting element 44, on an outer portion, arranged at a distance from the centre of the sliding board, of an engagement element 30*l*, 30*r* (in this case of the right engagement element 30*r*). In a preferred embodiment, the lever 50 transmits the forces necessary for the opening and closing to the holding means via a knee-joint arrangement, the knee-joint arrangement preferably comprising: a first pivot axle 42 for rotatably connecting the engagement element 30*r* to the connecting element 44, a second pivot axle 46 for rotatably connecting the connecting element 44 to the lever 50, and third pivot axle 48 for rotatably mounting the lever 50 on a tensioning element 52. For opening and closing, the lever 50 is pivoted about the pivot axle 48.

Figure 6:
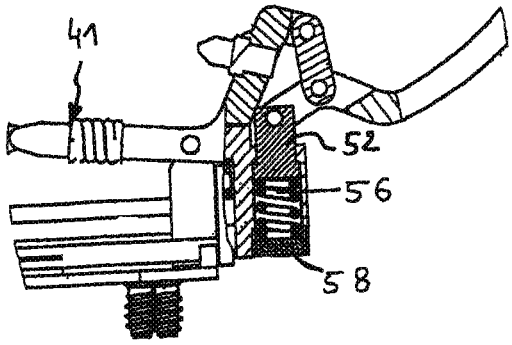
FIG. 6 is a sectional drawing of the front unit shown in FIG. 4 in a configuration ready for operation and in an open position.

Preferably, the tensioning element 52 is mounted so as to be movable substantially linearly in a guide element 54 and biased by a spring element 56; in particular, the movement of the tensioning element 52 can be delimited by a stop in the guide element 54. Also preferably, the position of the axles 42, 46 and 48 is selected in such a way that, in the closed position of the front unit, the spring element 56 provides a force via the knee-joint arrangement which locks the holding means of the front unit. As is shown in FIG. 6, one end of the spring element 56 is preferably supported by the tensioning element 52, and the other end is preferably supported by an adjustment element 58, by way of which the tension of the spring element 56 can be set. In particular, the adjustment element 58 is carried by the guide element 54. The guide element 54 is preferably attached to the bearing element, in the preferred embodiment shown in FIGS. 4 and 5 to the side bearing element 60*r*. The arrangement of the knee joint and the spring element 56 is in particular selected in such a way that, in a movement range of the holding means adjacent to the neutral position of the spring means 41, the locking means which comprises the knee joint and the spring element 56 provides a substantially constant force, so as to lock the front unit in the closed position. The lever 50 (locking element) is pivoted about the pivot axle 48 for locking. In particular, the arrangement of the knee joint and the spring element 56 is selected in such a way that, when the lever 50 pivots about the pivot axle 48 so as to lock the holding means of the front unit, this arrangement passes through a neutral position and is thus distinguished in particular by two stable states (locked and unlocked states).

Preferably, the at least one engagement element 30*l*, 30*r* is formed in such a way that it comprises two lever arms which are separated by the axis of rotation 34*l*, 34*r*, the first lever arm being connected to the tension springs 36*l*, 36*r* and the locking means cooperating with the other lever arm.

Figure 7:
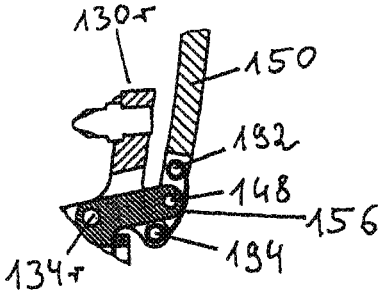
FIG. 7 is a sectional drawing of a front unit in accordance with a second embodiment of the present invention in a closed position.
Figure 8:
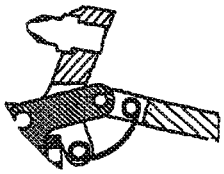
FIG. 8 is a sectional drawing of the front unit shown in FIG. 7 in an open position.

In the following, a second preferred embodiment of a front unit according to the present invention is described, reference only being made to differences from the first preferred embodiment. FIGS. 7 and 8 only include a detail of a side of the locking means; the fact that the illustration and the references are limited to just this one side does not mean that the embodiment is limited to just this one side. The second preferred embodiment of the front unit, shown in FIGS. 7 and 8, differs from the first embodiment by way of the formation of the locking means. The locking means comprises a lever 150 (locking element), which is mounted rotatably on a pivot axle 148, which is held fixed in place with respect to the position of an axis of rotation 134*r* of an engagement element 130*r*, a spring element 156 connecting the lever to the engagement element 130*r*. In particular, the spring element 156 acts on an actuation point 192 on the lever 150 and on an actuation point 194 on the engagement element 130*r*. The spring element 156 may be a leaf spring.

Preferably, the arrangement of the pivot axle 148, the actuation points 192 and 194 of the spring element and the spring element 156 is selected in such a way that, in a movement range of the holding means which is adjacent to the neutral position of a spring device acting between the engagement elements, the locking means, which comprises the lever 150 and the spring element 156, provides a substantially constant force, so as to lock the front unit in the closed position. The lever 150 (locking element) is pivoted about the pivot axle 148 for locking. In particular, the arrangement of the pivot axle 148, the actuation points 192 and 194 of the spring element 156 and the spring element 156 is selected in such a way that, when the lever 150 pivots about the pivot axle 148 so as to lock the holding means of the front unit, this arrangement passes through a neutral position and is thus distinguished in particular by two stable states.

In the following, a third preferred embodiment of a front unit 200 according to the present invention is described, reference only being made to differences from the first preferred embodiment.

Figure 9:
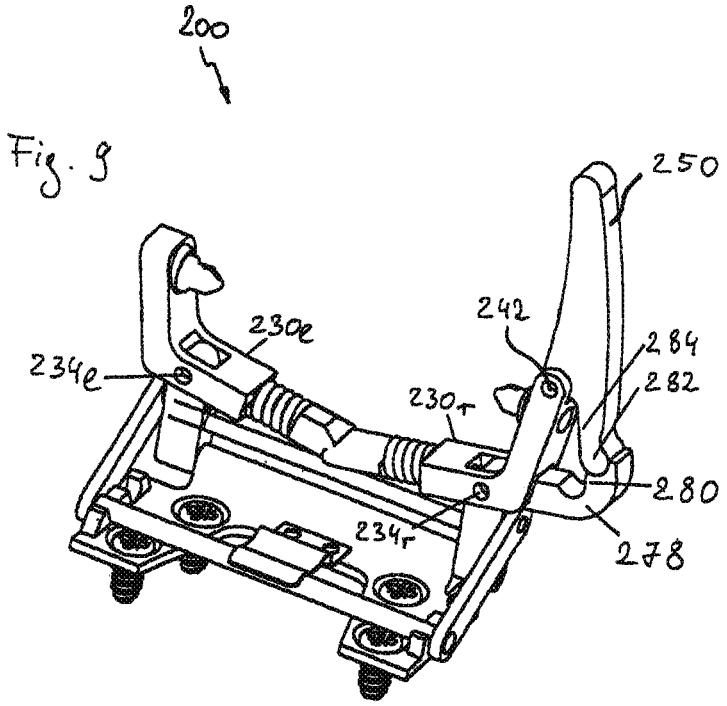
FIG. 9 is a perspective view of a front unit in accordance with a third embodiment of the present invention in a configuration ready for operation and in a closed position.

In the third preferred embodiment, as is shown in FIG. 9, the front unit 200 of a sliding board binding comprises a lever 250 (locking and operating element), which is mounted on an engagement element 230*l*, 230*r* rotatably about an axis 242 and which is connected via a cam mechanism to a counter holding-element 278, which is fixed in place with respect to the position of the axis of rotation 234*r* of the engagement element 230*r*.

Preferably, by moving the lever 250 outwards away from the sliding board centre, the holding means is caused to transition from the closed position to the open position, a force necessary for opening preferably being transmitted via the pivot axle 242 and an extension 284 of the lever 250 to an engagement element 230*r* when the lever 250 is opened.

Preferably, in the closed position of the holding means, the holding means is arrested by moving the lever 250 inwards towards the sliding board centre, the arrest resulting from the interaction of a cam 282 formed on the lever 250 with a guide face 280 formed on the counter-holding element 280, and the engagement elements thus being blocked from opening.

The invention claimed is:

1. A front unit of a sliding board binding, comprising a holding means which is set up so as to engage a sliding board boot and to hold the sliding board boot on the sliding board binding pivotably about a transverse axis extending transverse to a sliding board longitudinal axis, the front unit being adjustable between a closed position and an open position, in which closed position the holding means is raised in a configuration ready for operation so as to hold the sliding board boot pivotably engaged, in which open position the holding means releases the sliding board boot, wherein the front unit is adjustable into a passive position being a nonuse position, which passive position is different from the open position and the closed position and in which passive position the holding means is adjusted towards the sliding board into a flat configuration, such that the height of the front unit is less than 25 mm and the front unit is adapted to be located below the sole of the sliding board boot.

2. The front unit according to claim 1, wherein the adjustment of the front unit into the passive position comprises a pivoting movement of the holding means.

3. The front unit according to claim 1, wherein the holding means comprises at least one engagement element having a coupling means for coupling to a counter-coupling means of the sliding board boot, the engagement element being mounted rotatably about a first pivot axle to adjust the front unit between the closed position and the open position, and wherein the holding means for adjusting the front unit into the passive position is mounted rotatably about a second pivot axle, which is different from the first pivot axle.

4. The front unit according to claim 1, further comprising a locking means, so as to prevent the front unit from being adjusted into and/or out of the passive position when locked, and to make it possible for the front unit to be adjusted into and/or out of the passive position when non locked.

5. The front unit according to claim 1, wherein the holding means comprises two engagement elements, each engagement element having a coupling means for coupling to a counter-coupling means of the sliding board boot, and wherein the engagement elements are biased into the closed position by a spring means, in such a way that the coupling means engage the sliding board boot by clamping from opposite sides.

6. The front unit according to claim 5, wherein the spring means comprises an articulation, the engagement elements transitioning from the open position to the closed position as a result of the articulation moving, and wherein a neutral position of the spring means is passed through in the course of this transition.

7. The front unit according to claim 5, wherein the two engagement elements are pivotably mounted on a shared bearing element for adjustment between the open position and the closed position, and wherein the bearing element is mounted rotatably about an adjustment axis on a base plate of the front unit or on a base body attached to the base.

8. The front unit according claim 1, wherein the holding means comprises at least one engagement element having a coupling means for coupling to a counter-coupling means of the sliding board boot, wherein the front unit comprises an operating element for manually adjusting the front unit between the closed position and the open position, and wherein the operating element acts on an outer portion, arranged at a distance from a sliding board central axis, of the engagement element.

9. The front unit according to claim 1, wherein the holding means comprises at least one engagement element having a coupling means coupling to a counter-coupling means of the sliding board boot, a locking means, which is or can be positioned in a locking position in the closed position of the holding means, so as to exert an additional locking force towards the closed position on the holding means, and a locking element of the locking means acting on an outer portion, arranged at a distance from the sliding board central axis, of the engagement element.

10. A front unit of a sliding board binding, comprising a holding means which is set up so as to engage a sliding board boot and to hold it on the sliding board binding pivotably about a transverse axis extending transverse to a sliding board longitudinal axis, the holding means being adjustable between a closed position so as to hold the sliding board boot pivotably engaged, and an open position, in which the holding means releases the sliding board boot, a tensioning means, which controls the movement of the holding means between the closed position and the open position and biases the holding means into the closed position by way of a tensile force, and a locking means, which is or can be placed in a locking position in the closed position of the holding means, so as to exert an additional locking force towards the closed position on the holding means, wherein the locking means comprises a spring element for providing the locking force.

11. The front unit according to claim 10, wherein the holding means passes through a neutral position during the transition between the open position and the closed position and wherein the locking means provides a substantially constant locking force in a movement range adjacent to the neutral position.

12. The front unit according to claim 10, wherein the holding means comprises two engagement elements which are each held rotatably on an axis of rotation, each engagement element comprising:

a first lever arm which cooperates with the tensioning means, and a second lever arm which carries a coupling means for coupling to a counter-coupling means of the sliding board boot, the engagement elements are biased into the closed position by the tensioning means in such a way that the coupling means engage the sliding board boot by clamping from opposite sides, and the locking means cooperate with the second lever arm of one of the two engagement elements.

13. The front unit according claim 10, wherein the holding means comprises at least one engagement element, which is mounted rotatably about a pivot axle and comprises a coupling means for coupling to a counter-coupling means of the sliding board boot, and the locking means comprises a locking element, which is mounted rotatably about an axis which is kept stationary with respect to the position of the axis of rotation of the engagement element, the spring element connecting the locking element to the engagement element.

14. The front unit according to claim 10, wherein the locking means comprises a connecting element which is mounted on the engagement element rotatably about a first pivot axle, a locking element, which is connected to the connecting element rotatably about a second pivot axle, and a tensioning element which is biased by the spring element and is connected to the locking element rotatably about a third pivot axle.

* * * * *